US006581331B1

(12) United States Patent
Kral

(10) Patent No.: US 6,581,331 B1
(45) Date of Patent: Jun. 24, 2003

(54) WINDOW AND DOOR CLOSING MECHANISM

(76) Inventor: Joseph Michael Kral, 30 Ramsay Road, Five Dock, Sydney, NSW (AU), 2046

( * ) Notice: Subject to any disclaimer, the term of this patent is extended or adjusted under 35 U.S.C. 154(b) by 0 days.

(21) Appl. No.: 09/701,056

(22) PCT Filed: May 25, 1999

(86) PCT No.: PCT/AU99/00400

§ 371 (c)(1),
(2), (4) Date: Jan. 11, 2001

(87) PCT Pub. No.: WO99/61739

PCT Pub. Date: Dec. 2, 1999

(30) Foreign Application Priority Data

| | | |
|---|---|---|
| May 26, 1998 | (AU) | PP 3695 |
| Oct. 12, 1998 | (AU) | 6430 |
| Nov. 27, 1998 | (AU) | 7385 |

(51) Int. Cl.[7] ..... E05F 11/20

(52) U.S. Cl. ..... 49/339; 49/346; 49/252; 49/324

(58) Field of Search ..... 49/339, 345, 346, 49/246, 250, 252, 324; 16/357, 358, 361

(56) References Cited

U.S. PATENT DOCUMENTS

| | | | | | |
|---|---|---|---|---|---|
| 428,624 | A | * | 5/1890 | Morrell | 454/115 |
| 435,544 | A | * | 9/1890 | Morrell | 454/115 |
| 1,432,784 | A | * | 10/1922 | Putnam | 292/263 |
| 1,693,690 | A | * | 12/1928 | Corcoran | 49/339 |
| 2,366,613 | A | * | 1/1945 | Hagstrom | 49/252 |
| 5,035,463 | A | * | 7/1991 | Kato et al. | 296/146.11 |
| 5,581,941 | A | * | 12/1996 | Sill et al. | 49/246 |

FOREIGN PATENT DOCUMENTS

| | | |
|---|---|---|
| DE | 1 958 413 | 5/1971 |
| DE | 2 058 321 | 5/1972 |
| DE | 2 817 883 | 10/1979 |
| GB | 2 228 767 | 9/1990 |

* cited by examiner

*Primary Examiner*—Gregory J. Strimbu
(74) *Attorney, Agent, or Firm*—Harrison & Egbert

(57) ABSTRACT

A opening and closing mechanism for a door or a window including a stationary primary track, a movable secondary track, an operating member with one end pivotally fixed in the primary track and an opposite end movable along the secondary track, and a guide engageable with a guide surface of the operating member. The guide surface is curved along at least a portion of a length thereof such that a tangent to the guide surface at a point where the guide surface crosses a longitudinal center line of the primary track forms an acute angle with the center line. The acute angle is substantially constant throughout the range of pivotal movement of the operating member.

13 Claims, 6 Drawing Sheets

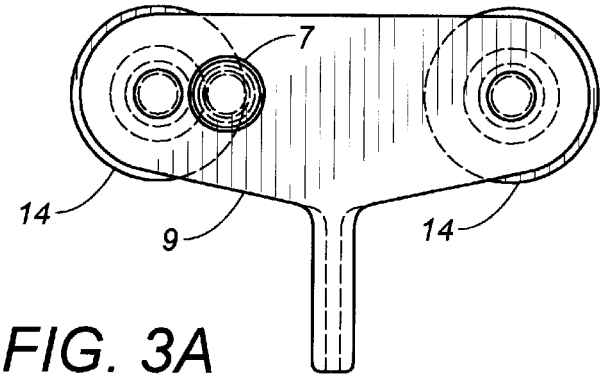
FIG. 3A
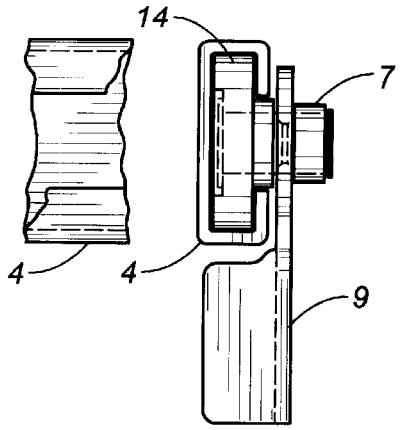
FIG. 3B
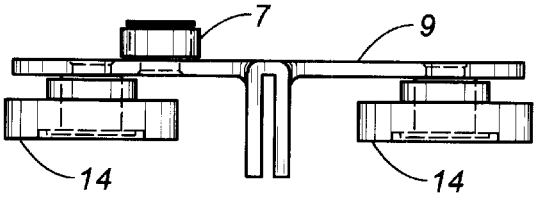
FIG. 3C
FIG. 4A
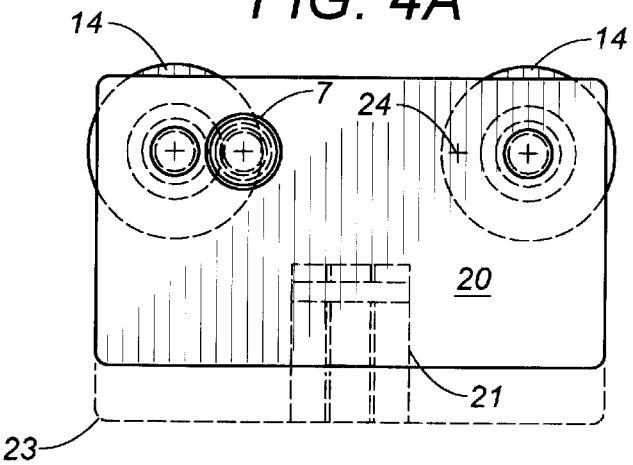
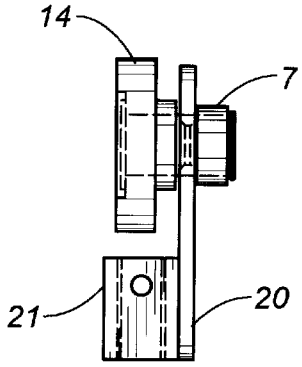
FIG. 4B
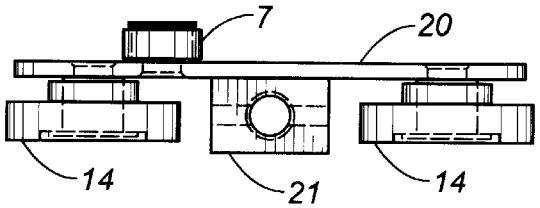
FIG. 4C 66
65
74
73
79
78
77
66
68
72
71
63
65
65
74
80
70
78
69
75
76
70
71
75
64
73
79
77

WINDOW AND DOOR CLOSING MECHANISM

BACKGROUND OF THE INVENTION

1. Field of the Invention

The present invention relates to window closers, window stays and door closers. The invention also relates more generally to mechanisms such as, though not limited to, window closers, window stays and door closers which operate on a wedge principle. For example, the invention may be applicable to scissor-action mechanisms which incorporate a wedge principle of operation.

2. Description of Related Art

Present window closers include latches, chain winders and wire winders. Window latches cannot be used as stays and only latch in the final, lock-up position. Therefore, friction, a notch or some other type of stay is required to maintain a window or door ajar. Chain and wire winders do not require additional stays, however both are vulnerable in the open position to outside factors. Both, the chain and the wire tend to deflect and allow the window to partially close. A latch is usually required to secure the window in the closed position.

Present door closers include spring loaded member mechanisms with hydraulic or pneumatic braking arrangements to prevent slamming of the door. Some less expensive door closers do not incorporate the braking arrangement.

BRIEF SUMMARY OF THE INVENTION

It is the object of the invention to overcome or substantially ameliorate at least one of the above disadvantages and/or more generally to provide improved window and door closing mechanisms.

There is disclosed herein an opening/closing mechanism for a window or door, the mechanism including:

a primary track secured to or formed integrally with a window or door jamb, a secondary track secured to or formed integrally with a window or door frame, an operating member pivotally secured at one end thereof to the primary track and/or window/door jamb, and mounted at its other end so as to be linearly moveable along the secondary track, the operating member including a guide surface which extends along the member, the association of the operating member with the primary track being such that a line parallel to the guide surface crosses a longitudinal centre line of the primary track at a substantially constant, shallow, acute angle throughout a substantial range of operation of the mechanism, and wherein the guide surface includes a curved profile along at least a part of its length, and a guide including means engageable with said guide surface, the guide being retrainedly moveable along said primary track whereupon interaction of the guide with the guide surface causes pivotal movement of said operating member about said one end thereof.

Preferably the guide surface is an edge of a slot formed in the operating member, the line parallel to the guide surface being a centre line of the slot.

Preferably the guide includes a roller car which can roll along the primary track and includes a guide roller which rides along the slot.

Preferably the point of pivotal attachment of the operating member to the primary track is linearly moveable along the primary track, the guide being fixed to the primary track.

There is further disclosed herein an opening/closing mechanism for a parallel opening window, the mechanism including:

a primary track secured to or formed integrally with a window jamb, a secondary track secured to or formed integrally with a window frame, a pair of operating members each pivotally secured at one end thereof to the primary track and/or window jamb, and each being pivotally mounted to, and so as to be linearly moveable along, the secondary track, the operating members each including a guide surface which extends along the member, the association of the operating member with the primary track being such that a line parallel to the guide surface crosses a longitudinal centre line of the primary track at a substantially constant, shallow, acute angle throughout a substantial range of operation of the mechanism, and wherein said guide surface includes a curved profile along at least a part of its length, and a pair of guides, each including means engageable with said guide surface of a respective one of said operating members, the respective guide being restrainedly moveable along said primary track whereupon interaction of the guide with the respective guide surface causes pivotal movement of said respective operating member about said one end thereof.

Preferably each guide surface is an edge of a slot formed in the respective operating member, said line parallel to the guide surface being a centre line of the slot.

Preferably the guide includes a roller car which can roll along the primary track and includes a guide roller which rides along the slot.

Preferably the roller cars are attached to a wire rope or other flexible tension member, which wire rope passes around a sheave to a drum, rotatable by means of a handle, rotation of the handle thus causing movement of the respective roller car to effect movement of the window.

Preferably there is associated with each operating member a scissor member, each respective scissor member being pivotally interconnected to both the primary and secondary tracks.

There is further disclosed herein an opening/closing mechanism for an awning type window, the mechanism including:

a slide rod secured to or formed integrally with a window jamb, a track secured to or formed integrally with a window frame, an operating member pivotally, slidably attached at one end thereof to the track and slidably attached at the other end thereof to the slide rod so as to pivot about the longitudinal axis of the slide rod and an axis normal thereto, the operating member including a guide surface which extends along the member, wherein a line parallel to the guide surface and the longitudinal axis of the rod cross each other at a substantially constant, shallow, acute angle throughout a substantial range of operation of the mechanism, and rotational means associated with the window jamb and engageable with the operating member so as to slide said one end thereof along said rod and pivot same about both said axes.

Preferably the mechanism includes a base frame that includes a pair of bearing blocks, a guide block and a swing block, the bearing blocks supporting said slide rod.

Preferably a slide block is slidably attached to the slide rod and the operating member is pivotally affixed to the slide block.

Preferably one elongated edge of the operating member is smooth, whereas the opposed edge is provided with a curved rack of gear teeth.

Preferably there are two bearing blocks supporting the slide rod and between which the slide block slides and wherein there is provided a connecting rod between the guide block and the swing block along which the slide block also slides, the connecting rod being parallel to the slide rod and maintaining the guide block and slide block in aligned association when pivoting about the longitudinal axis of the slide rod.

Preferably the rotational means includes a gear mounted upon the guide block, the gear being inter-engaged with the rack of teeth.

Preferably the gear is driven by a drive gear which is rotated by means of a handle.

There is further disclosed herein an opening/closing mechanism for a door, the mechanism including:

a pair of guide rods secured to the door jamb, a track secured to the door, an operating member pivotally secured at one end thereof to said guide rods and pivotally mounted to the track so as to be linearly moveable therealong, the operating member including a guide surface which extends along the member.

a guide including means engageable with said guide surface, the association of the operating member with the track being such that a line parallel to the guide surface crosses a straight line passing through the centre in between the guide rods and the point of pivotal attachment of the operating member to the door jamb at a substantially constant, shallow, acute angle throughout a substantial range of operation of the mechanism.

Preferably the guide surface includes a curved profile along at least a part of its length.

Preferably the guide surface is an edge of a slot.

Preferably the guide includes a guide roller received within the slot.

Preferably the line parallel to the guide surface is the centre line of the slot, operation of the mechanism.

Preferably the angle varies by providing a fluctuation or fluctuations in the curve of the guide surface.

Preferably, in all of the above embodiments, the angle of crossing is substantially constant. In the door opening/closing mechanism, this angle may be varied by providing a fluctuation or fluctuations in the curve of the guide surface to decelerate the door during its closing movement.

Typically, the primary slide track is affixed to the head of the door jamb through the end blocks and the secondary slide track is affixed to the top of the door. When the door is opened, one end of the operating member moves with it through the pivotally attached slide engaged in the secondary slide track. The other end of the operating member pivots on a pivot pin affixed to the near end block, one side of the slot in the operating member exerting force upon the roller affixed to the sliding block and forcing the sliding block to slide towards the near end block, thereby tensioning the spring. When the door is released, the spring recoils and forces the sliding block towards the outer end block, exerting force through the said roller upon one side of the slot in the operating member, causing the operating member to pull the door shut through the pivotally affixed slide engaged within the secondary slide track affixed to the door.

BRIEF DESCRIPTION OF THE SEVERAL VIEWS OF THE DRAWINGS

Preferred forms of the present invention will now be described by way of example with reference to the accompanying drawings.

FIG. 3*a* is a side view of a directly operated roller car;

FIG. 3*b* is an end view of a directly operated roller car;

FIG. 3*c* is a top view of a directly operated roller car;

FIG. 4*a* is a side view of a remotely operated roller car;

FIG. 4*b* is an end view of a remotely operated roller car;

FIG. 4*c* is a top view of a remotely operated roller car;

DETAILED DESCRIPTION OF THE INVENTION

Figure 1:
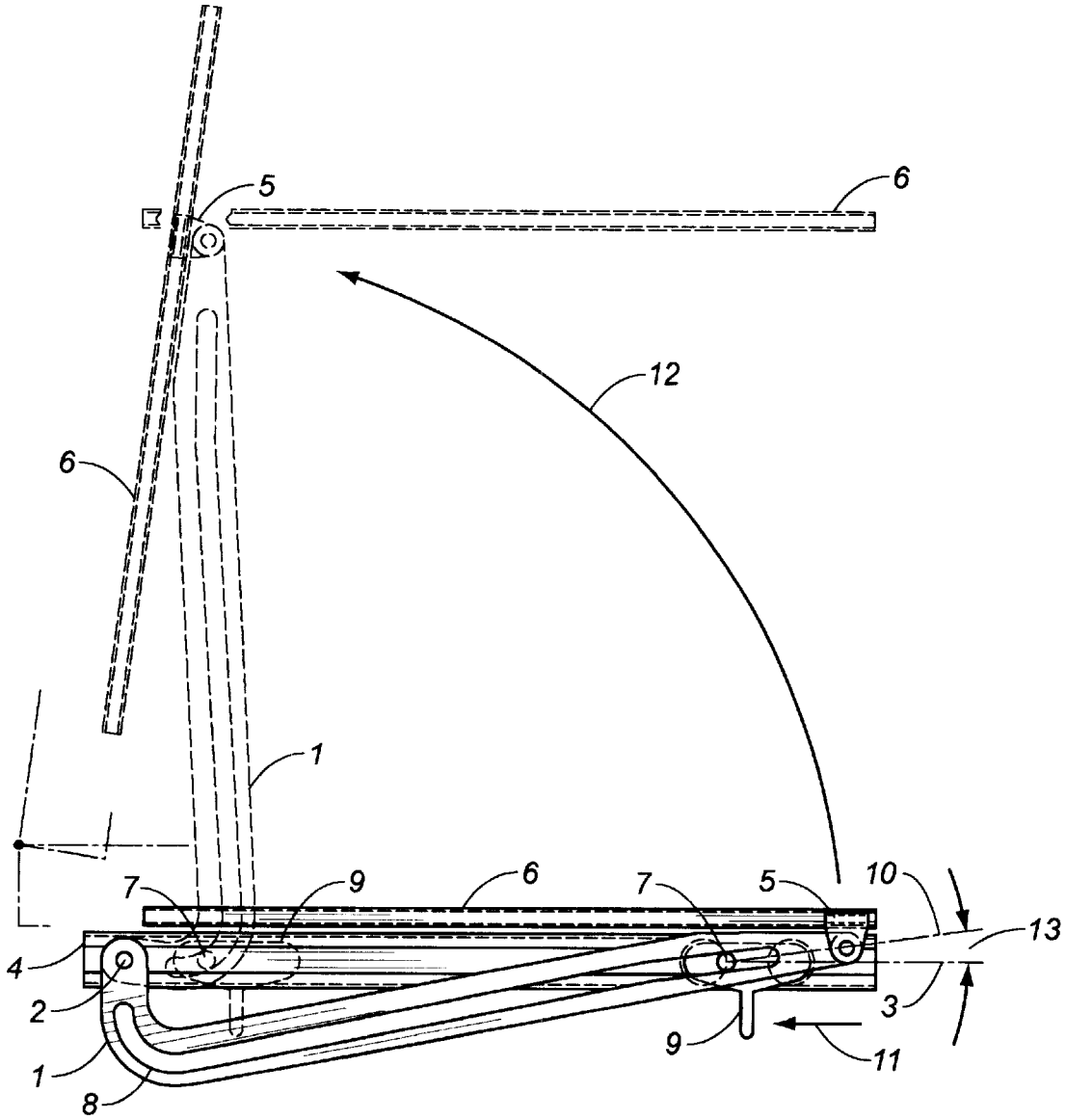
FIG. 1 is a schematic plan view of a closer.

In FIGS. 1 and 3 of the accompanying drawings, there is schematically depicted a mechanism for opening and closing windows. The mechanism includes an operating member 1 typically interconnected between a primary slide track 4 and a secondary slide track 6. The primary slide track 4 is intended to be secured to a window jamb whereas the secondary slide track 6 is intended to be affixed or formed integrally with a window frame. The near end of the operating member 1 is anchored on the centre line 3 to the primary slide track 4 by a pivot pin 2. The outer end of the operating member 1 is fitted with a pivoted slide 5 which is engaged into the secondary slide track 6. A roller car 9 incorporates guide wheels 14 which keep it constantly aligned with the centre line 3 of the primary slide track 4.

A guide roller 7 is affixed to the body of the roller car 9 and is engaged in the slot 8 of the operating member 1.

The centre line 10 of the slot 8 in the operating member 1 crosses the centre line 3 of the primary slide track 4 at an acute angle 13 which remains substantially constant through all stages of operation of the operating member 1, thereby providing ease of operation and self locking capability.

When the roller car 9 operates in direction 11, the guide roller 7 exerts force upon the upper side of the slot 8, causing the operating member 1 to travel in direction 12, moving the pivoted slide 5 and the secondary slide track 6 to a desired position. The purpose of the curved portion of the slot 8 is to ensure that a substantially even force is exerted between the operating member 1 and the guide roller 7 throughout the operation of the device.

The roles of the pivot pin 2 and the guide roller 7 may be reversed, whereby the pivot pin 2 would be mounted on a car not unlike the roller car 9 which can travel along the centre line 3 of the primary slide track 4. The guide roller 7 would be affixed to the primary slide track 4.

Figure 2:
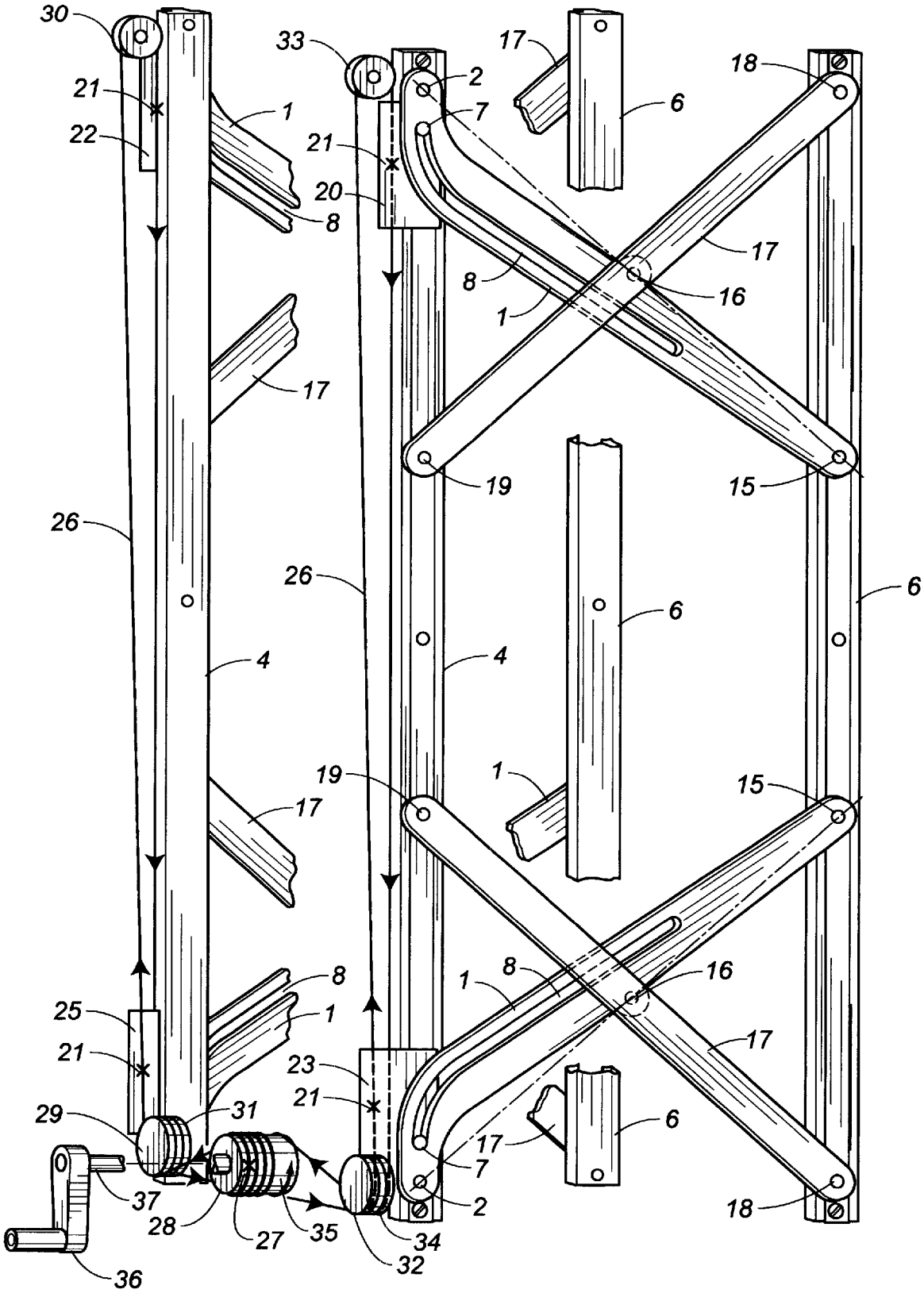
FIG. 2 is a schematic perspective view of a closer having a scissor mechanism.

In FIGS. 2 and 4 of the accompanying drawings, there is schematically depicted a remotely controlled opening and closing mechanism for parallel opening windows. In this embodiment, the near ends of the operating members 1 are anchored by pivot pins 2 to the outer ends of the primary slide tracks 4. The outer ends of the operating member 1 incorporate pins 15 which serve as axles for guide wheels which travel within the secondary slide track 6. At centres 16, directly in the middle between the anchor pivot pins 2 and the axle pins 15, there are pivotally attached sets of scissor members 17, the pivotal centres 16 being directly in the middle between the scissor members' pivotal anchors 18 and pins 19 which serve as axles for guide wheels which travel within the primary slide tracks 4.

The roller car 20 in FIG. 4 is fitted with guide wheels 14 which travel within the primary slide track 4. A guide roller 7 and a wire rope anchor block 21 are affixed to the body of the roller car 20. The roller car 22 is a mirror image of the roller car 20.

The body of the roller car 23 is extended in relation to the roller cars 20 and 22 and the roller 7 is here fitted at position 24. The roller car 25 is a mirror image of the car 23.

A flexible wire rope 26 is anchored at point 27 to the reel 28, runs a number of turns around the reel 28, passes around the sheave 29, through the anchor block 21 of the roller car 25 where it is anchored, continues to and around sheave 30, through the anchor block 21 of the roller car 22 where it is anchored, continues to and around sheave 31, passes under the reel 28 to and around sheave 32 and through the anchor block 21 of the roller car 23 where it is anchored onto and around sheave 33, through the anchor block 21 of the roller car 20 where it is anchored, continues to and around sheave 34, continues to and around the reel 28 to the anchor point 35 where it is anchored and terminated after forming a continuous loop. When the crack member 36 is operated in an anti-clockwise direction, the shaft 37 operates the reel 28, the flexible wire rope 26 coming from the sheave 32 is wound onto the reel 28 and the flexible wire rope 26 leading to the shave 29 is unwound from the said reel 28. The arrows show directions of travel of roller cars 20, 22, 23 and 25.

The roller cars move in unison. The guide rollers 7 affixed to the roller cars exert force upon the sides of the slots 8 in the operating members 1, causing motion to the operating members 1 and through pivots 16, to the scissor members 17, providing parallel motion of the secondary slide tracks 6 towards and in respect to the primary slide tracks 4.

The scissor mechanism in this embodiment may be modified by shortening the operating members 1 to where they engage the pivoting centres 17 and by modifying the slots 8 as required to provide full closure of the mechanism. In this variation, the secondary slides are no longer required and pivots 18 may be directly affixed to the window.

Figure 5:
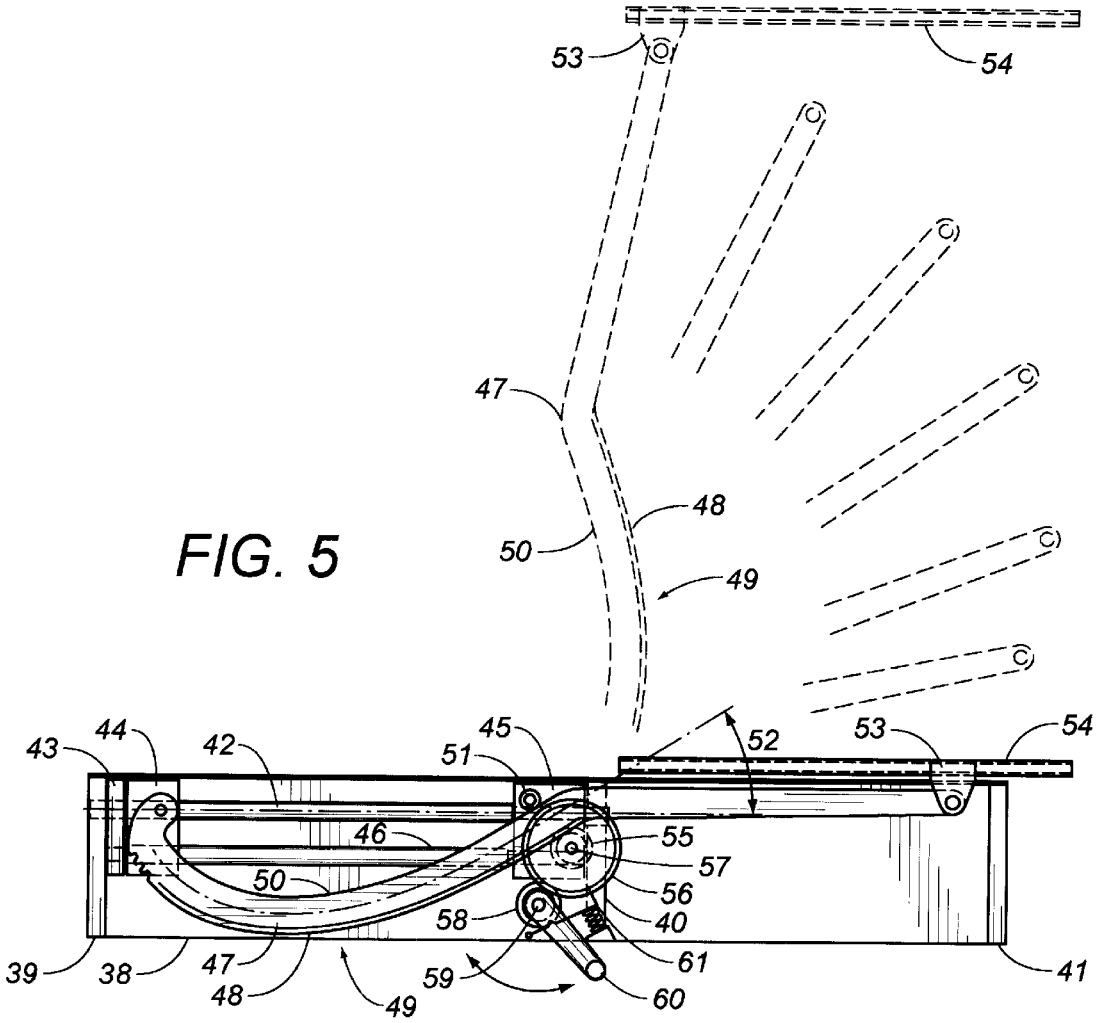
FIG. 5 is a schematic plan view of a gear driven closer.
Figure 6:
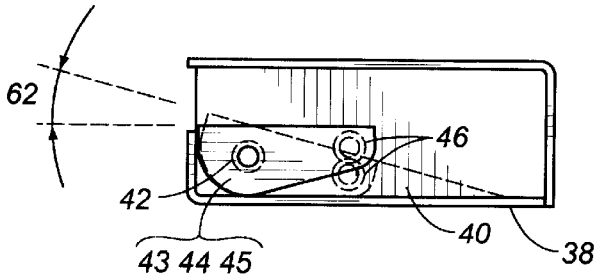
FIG. 6 is an enlarged, partial slide elevation of a gear driven closer.

In FIGS. 5 and 6, there is schematically depicted a closer for awning type windows. In this embodiment, the base frame 38 incorporates a bearing block 39 which also serves as a frame side block. The base frame also includes a bearing block 40 and a side block 41. The bearing blocks 39 and 40 support a main slide rod 42 which in turn supports a swing block 43, a pivot slide block 44 and a guide block 45. A connecting rod 46 which is parallel to the main slide rod 42 is firmly affixed to the swing block 43 and the guide block 45, thereby forming an assembly which allows the pivot slide block 44 to slide freely between the swing block 43 and the guide block 45 and, in addition, allows the three blocks 43, 44 and 45 to swing in unison, providing a variable operating angle 62 for the operating member 47 which is pivotally affixed to the pivot slide block 44. The operating member 47 incorporates gear teeth 48 at the outer side of the curved section 49. The inner side 50 of this curved section 49 is smooth to provide a smooth running surface for the guide roller 51 which is affixed to the guide block 45. The inner side 50 of the operating member 47 and the datum line of the gear teeth 48 are parallel in relation to each other. The centre line of the curved section 49 of the operating member 47 and the centre line of the main slide rod 42 cross each other at a constant, shallow angle 52. A slide 53 is pivotally affixed to the far end of the operating member 47 and travels freely within a slide track 54. The slide track is to be affixed to an awning type window.

A gear 55 is mounted upon the guide block 45, directly opposite the guide roller 51. The teeth of the gear 55 mesh with the teeth 48 of the operating member 47.

The gear 55 of the guide roller 51 provide a firm guide, locating the operating member 47 therebetween, in a similar manner as rollers 7 guide the operating members 1 in the embodiment of FIGS. 1 and 2.

A gear 56 which has a greater number of teeth than the gear 55 is affixed to the gear 55 and they rotate in unison on a common axle 57 which is affixed to the guide block 45. Gear 58, with a lesser number of teeth than gear 56 is affixed to a shaft 59. Also affixed to the shaft 59 is a crank handle 60. A spring loaded catch 61 locks the gear 56 and prevents movement of the operating member 47. When the crack handle 60 is rotated in an anti-clock-wise direction, the shaft 59 transmits this motion to gear 58 which lifts the catch 61, allowing gear 56 to rotate and turn the gear 55 which drives, through teeth 48, the operating member 47, pulling with it the pivot slide block 44 and with the aid of the guide roller 51, forcing the slide 53 and the slide track 54 away from the base frame 38 of the closer.

As an alternative to a gear operable mechanism, the rod 42, instead of being a fixed, smooth surfaced rod might be an externally threaded component adapted to rotate about its longitudinal axis. The slide block 44 might than be internally threaded so as to cooperate with the external thread of rod 42. The rod 42 could be driven to rotate by means of a "constant velocity" type sequence of universal joints between the end of the rod and a manually rotatable handle.

Figure 7:
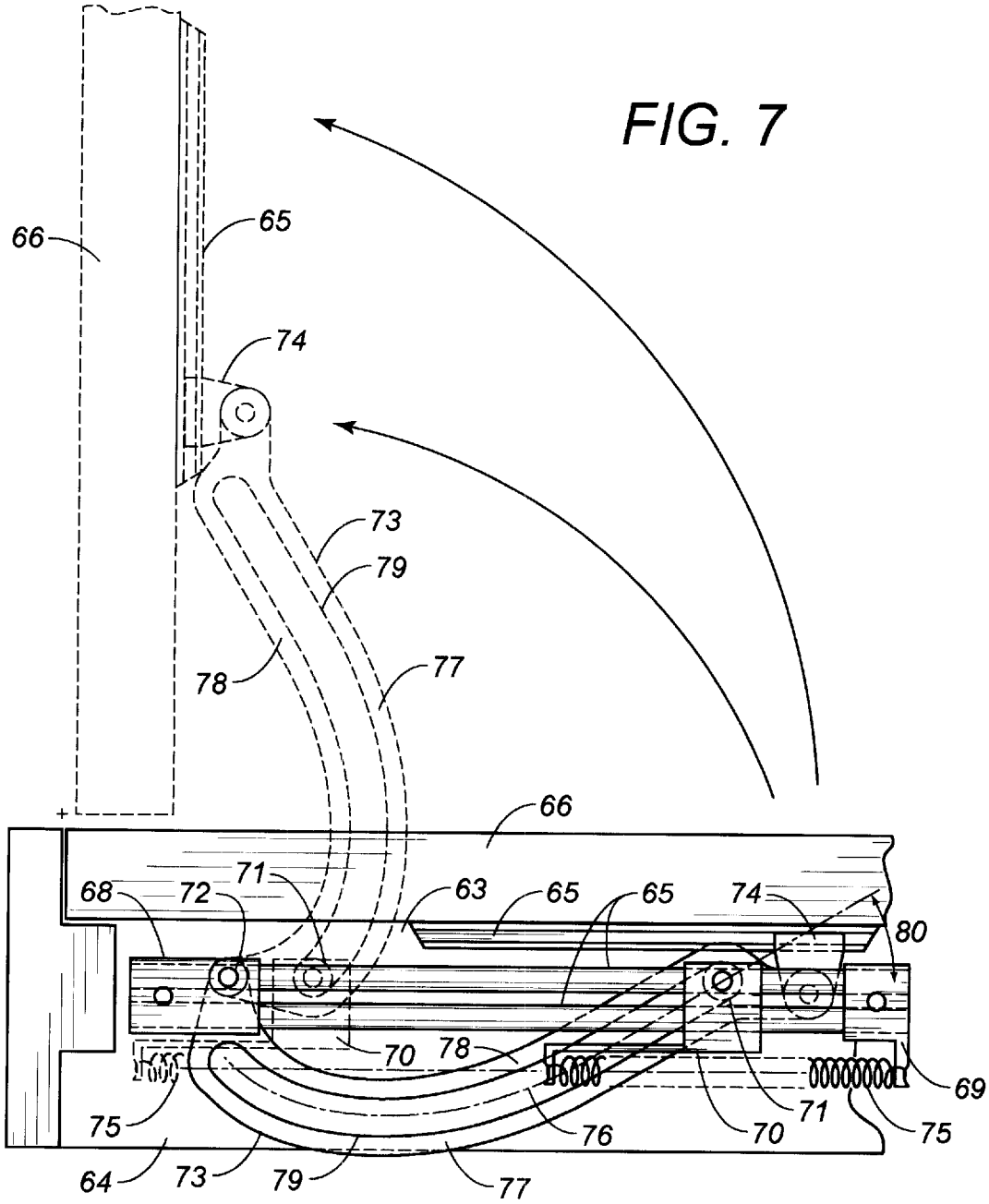
FIG. 7 is a schematic plan view of a door closer.

In FIG. 7, there is schematically depicted an automatic door closer. In this embodiment, the primary slide track 63 is affixed to the head of the doorjamb 64 and the secondary slide track 65 is affixed to the top part of the door 66. The primary slide track 63 incorporates two slide rods 67 anchored within a near side block 68 and the far side block 60 to form parallel slide tracks, along which a sliding block 70 slides freely. A guide roller 71 is affixed to the sliding block 70 and is engaged in the slot of the operating member 73 which is pivotally attached to the near side block 69 by a pivot pin 62. To the far end of the operating member 73, there is pivotally attached a slide 74 which slides freely within the secondary slide track 65. A spring 75 is attached to the far side block 69 and the sliding block 70. The centre line 76 of the slot in the operating member 73 and the centre line which passes directly through the centres of the guide roller 71 and the pivot pin 62 cross each other and form an acute angle 80 which is substantially constant but may be varied to facilitate increases or decreases in the speeds of operation.

It is to be noted that the slot in the operating member 73 is not essential to the operation of the closer, only the outer part 77 of the operating member 73 is necessary. However, the inner part 78 does provide additional strength and ease of handling.

When the door 66 is pushed open, the slide 74, pivotally affixed to the operating member 73 and engaged within the secondary slide track 65 which is affixed to the said door 66, pulls the free end of the pivoted operating member 73 with it, causing the outer surface 79 of the operating member 73 to exert force upon the guide roller 71 affixed to the sliding block 70, causing the sliding block 70 to slide along the two slide rods 67 towards the near side block 68, and tensioning the spring 75 in the process.

When the door 66 is released, the spring 75 recoils and forces the sliding block 70 towards the far side end block 69, exerting force through the guide roller 71 upon the outer surface 79 of the slot in the operating member 73, causing the operating member 73 to pull the door 66 shut through the pivotally affixed slide 74 engaged within the secondary slide track 65, affixed to the door 66.

Figure 8:
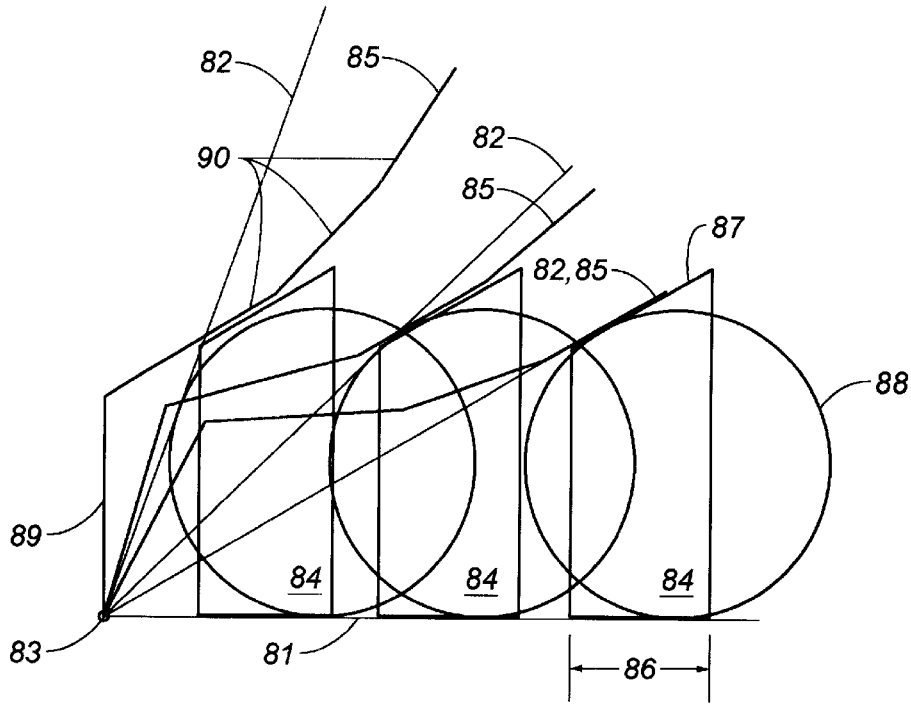
FIG. 8 is a schematic illustration depicting a method adopted in determining the curvature of the guide surface.

In FIG. 8 there is schematically depicted a diagram which illustrates certain principles of the present invention. Two lines 81 and 82 radiate from a pivot pin 83. A wedge shape 84 is depicted in three positions to illustrate the relationship between the wedge 84 and the lines 81 and 82. The lines 81 and 82 represent the lines to two members of a mechanism pivotally interconnected at 83. The line 81 is stationary, whereas the line 82 moves about the pivot point 83.

When the wedge 84 is pushed from its original position 86 towards the pivot point 83, it causes the line 82 to swing in an arc away from line 81. As can be seen, the angle between the line 82 and the wedge plane 87 changes through this operation, degrading the wedge effect, increasing friction at a contact point between the upper left corner of the wedge and the line and reducing leverage.

If the wedge 84 is replaced by a round shape 88, representing a roller for example, friction is reduced, the wedge effect is retained, however the leverage is reduced. To circumvent this disadvantage, the line 82 is modified to become the modified line 85, incorporating a lever 89 and angled segments 90 which cooperate, if crudely, with the wedge plane 87, thereby forming a substantially constant angle throughout the operation.

The above described principle may be applied in many ways. For example, the lines 81 and 82 can be straight and the form of wedge 84 can be unequal. Alternatively, the wedge 84 can be equal in shape. Either one of the lines 81 and 82 can be stationary or pivotable. The pivot point 83 can be stationary and the wedge 84 or roller 88 can be mobile. Alternatively, the pivot point 83 can be mobile and the wedge 84 or roller 88 can be made stationary. Either line may have a lever section, such as section 89 added to increase leverage. Wedge 84 may be substituted with roller 88.

Member 81 can be straight and member 82 can be substituted with a modified member 85. The wedge effect is provided by the wedge 84, an equal wedge or a roller 88. Either one of the lines 81 and 85 can be stationary or pivotable. The pivot point 83 can be stationary and the wedge 84 or roller 88 can be mobile. Alternatively, the pivot point 83 can be mobile and the wedge 84 or roller 88 can be stationary.

Figure 9:
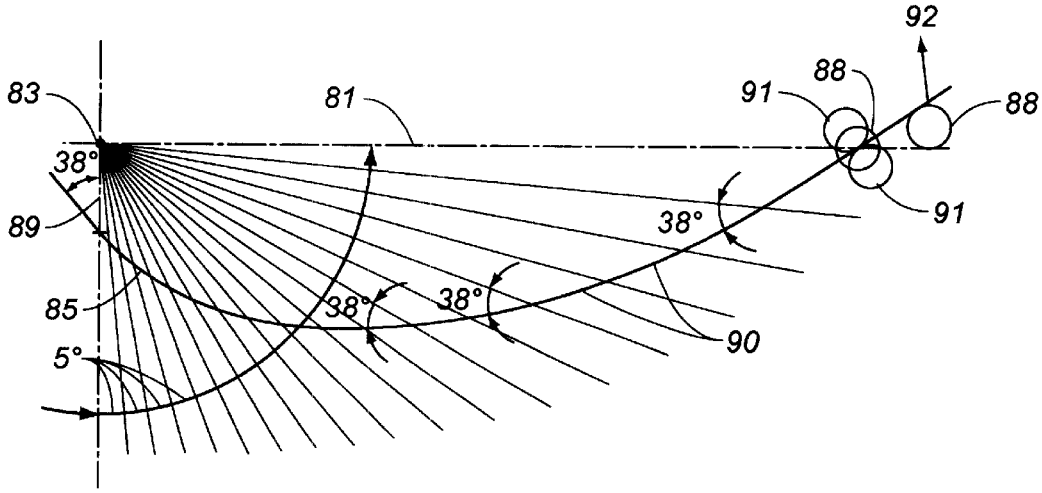
FIG. 9 is a schematic illustration depicting a refined means of determining the curvature of the guide surface so as to maintain a constant crossing angle.

In FIG. 9 of the accompanying drawings, the flat segments 90 of FIG. 8 are refined, the intention being to approximate a smooth curve. This may be attained in the following manner: a number of radial lines are drawn from the pivot point 83. These radial lines may be drawn at 5° increments. A line is drawn at, say 38° across a first of the radial lines. The point at which this line intersects the next radial line then has another line drawn at 38° therefrom to the next radial line and so on. The angle of 38° is arbitrary as is the choice of 5° for the radial line increments. An angle acuter than 38° would provide a greater wedge effect and increments of less than 5° would provide a smoother curve.

With reference to FIGS. 1, 2, 5 and 7 of the accompanying drawings, line 81 represents the primary track and the line 85 represents the centre line of the slot in the operating member within which the wedge roller 88 is engaged, or the centre line of the body of the operating member. This requires two rollers 91 to provide the desired wedge effect in both directions.

When the wedge roller 88 or rollers 91 are moved towards the pivot point 83 or the pivot point 83 is moved towards the roller 88 or rollers 91 along the primary track 81, the wedge effect causes the outer end of the operating member 85 to swing in direction 92.

The reason for so forming the curve in slot 79 is to ensure that a substantially even force occurs between the slot and the guide roller 71 throughout the operational movement of the apparatus. This principle applies to the operating members of all of the above disclosed embodiments.

I claim:

1. An opening and closing mechanism comprising:

a stationary primary track;

a movable secondary track movable with respect to said primary track;

an operating member having one end pivotally fixed to said primary track and an opposite end movable along said secondary track, said operating member having a guide surface extending therein, said guide surface having a length;

a guide engageable with said guide surface and restrainedly movable along said primary track so as to cause pivotal movement of said operating member about said one end thereof, said guide surface being curved along at least a portion of said length thereof such that a tangent to said guide surface at a point where said guide surface crosses a longitudinal center line of said primary track forms an acute angle with said longitudinal center line, said acute angle being substantially constant throughout an approximately full range of said pivotal movement of said operating member.

2. The mechanism of claim 1, said guide surface being an edge of a slot formed in said operating member.

3. The mechanism of claim 2, said guide comprising a roller car which is rollable along said primary track, said roller car having a guide roller which is ridable in said slot in said operating member.

4. An opening and closing mechanism for a parallel opening window comprising:

a stationary primary track;

a movable secondary track;

a pair of operating members each having one end which is pivotally fixed relative to said primary track, each of said operating members having another end which is movable along said secondary track, each of said pair of operating members further comprising a guide surface extending therein;

a pair of guides respectively engageable with the guide surfaces of said pair of operating members and restrainedly movable along said primary track so as to cause pivotal movement of each of the operating members about said one end thereof, each of said guide surfaces being curved along at least a portion of a length thereof of such that a tangent to said guide surface at a point where said guide surface crosses a longitudinal center line of said primary track forms an acute angle with said longitudinal center line, each of said acute angles being substantially constant throughout an approximately full range of pivotal movement of a respective one of said operating members.

5. The mechanism of claim 4, said guide surfaces each being an edge of a slot formed in the respective operating member, each of said slots having a center line parallel to said guide surface.

6. The mechanism of claim 5, each of said pair of guides comprising a roller car which is rollable along said primary track, each said roller car comprising a guide roller which is ridable in a respective one of said slot.

7. The mechanism of claim 6, each said roller car being attached to a flexible tension member, said flexible tension member passing over a drum, said drum being rotatable by a handle, said handle connected to said drum such that a rotation of said handle causes a corresponding movement of said roller cars.

8. The mechanism of claim 4, each of said pair of operating members further comprising a scissor member, said scissor members being pivotally interconnected to each of said primary track and said secondary track.

9. A mechanism comprising:

a door;

a door jam;

a pair of guide rods secured to said door jam;

a track secured to said door;

an operating member having one end pivotally fixed to said pair of guide rods and another end pivotally mounted to said track so as to be movable therealong, said operating member further comprising a curved guide surface which extends therealong; and a guide engageable with said guide surface and movable along said guide rods so as to cause pivotal movement of said operating member, said operating member being oriented such that a tangent to said guide surface crosses a straight line passing between and substantially parallel to said pair of guide rods at an acute angle, said acute angle being substantially constant throughout an approximately full range of pivotal movement of said operating member with respect to said pair of guide rods.

10. The mechanism of claim 9, said guide surface being an edge of a slot.

11. The mechanism of claim 10, said guide further comprising a guide roller received within said slot.

12. The mechanism of claim 10, said guide surface having a line parallel thereto, said line being a center line of said slot.

13. The mechanism of claim 9, said acute angle being variable by a fluctuation in the curve of said guide surface.

* * * * *